US007488198B2

(12) United States Patent
Shiu et al.

(10) Patent No.: US 7,488,198 B2
(45) Date of Patent: Feb. 10, 2009

(54) ELECTRICAL CONNECTOR WITH IMPROVED TERMINALS

(75) Inventors: Guo-Jiun Shiu, Tu-Cheng (TW); Min-Han Lin, Tu-Cheng (TW); Ti-Li Wei, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/789,136

(22) Filed: Apr. 24, 2007

(65) Prior Publication Data

US 2007/0249217 A1 Oct. 25, 2007

(30) Foreign Application Priority Data

Apr. 24, 2006 (TW) ..... 95206937 U

(51) Int. Cl.
*H01R 9/07* (2006.01)

(52) U.S. Cl. ..... 439/495

(58) Field of Classification Search ..... 439/495, 439/83, 260, 64, 571
See application file for complete search history.

(56) References Cited

U.S. PATENT DOCUMENTS

| | | | | |
|---|---|---|---|---|
| 3,199,066 | A * | 8/1965 | Eledge et al. | 439/857 |
| 5,199,895 | A * | 4/1993 | Chang | 439/326 |
| 5,904,589 | A * | 5/1999 | Asakawa | 439/495 |
| 6,004,156 | A | 12/1999 | Roque et al. | |
| 2004/0002254 | A1 * | 1/2004 | Tsunematsu | 439/495 |

* cited by examiner

*Primary Examiner*—Alexander Gilman
(74) *Attorney, Agent, or Firm*—Wei Te Chung

(57) ABSTRACT

An electrical connector assembly comprises an electrical connector (100) for connecting a sheet-like connection member (5) with a plurality of conductive pads (50) thereon. The electrical connector includes an insulating housing (1) defining a receiving cavity (10) for receiving the FPC and a plurality of conductive terminals (2) retained in the insulating housing to connect the corresponding conductive pads. Each terminal (2) comprises two resilient arms (24,25) located at one side of the receiving cavity (10) and having contact portions at their distal ends to be exposed to the receiving cavity to electrically contact with one single conductive pad (50) which can increase the reliability of the connection between the conductive terminal and the conductive pad of the FPC.

20 Claims, 5 Drawing Sheets

ELECTRICAL CONNECTOR WITH IMPROVED TERMINALS

BACKGROUND OF THE INVENTION

1. Field of the Invention

The present invention relates to an electrical connector, and more particular to an electrical connector for a sheet-like connection member such as a flexible printed circuit (FPC) and a flexible flat cable and so forth. All of these cables and circuit hereafter will be generally referred to as "FPC" for simplification.

2. Description of Related Art

U.S. Pat. No. 6,004,156 discloses an electrical connector, which is used for connecting an FPC. The electrical connector includes an insulating housing having an upper wall, a lower wall and a receiving cavity between the upper and lower walls, a plurality of terminals received in housing, and a pressing member mounted on the housing. Each terminal has a fixed arm retained in the lower wall and a resilient arm with a contact portion exposed to the receiving cavity received in the upper wall. The FPC has a plurality of conductive pads at one end for electrically contacting with the contact portions of the terminals. When the FPC is inserted into the receiving cavity, the pressing member urges the FPC to move upward, thereby electrical connections is achieved between the conductive pads and the terminals.

However, the conductive pads of the FPC are prone to be oxidized or covered with dust or other unexpected material, the preferred electrical connections between the conductive pads and the contact portions are hardly achieved. So a new design with high performance is required.

SUMMARY OF THE INVENTION

Accordingly, an object of the present invention is to provide an electrical connector with high conductive capability.

In order to achieve the object set forth, an electrical connector is provided. The electrical connector assembly includes an electrical connector and a sheet-like connection member provided with a plurality of conductive pads. The electrical connector comprises an insulating housing defining a receiving cavity for receiving the sheet-like connection member along a front-to-back direction; and a plurality of conductive terminals retained in the housing to connect the corresponding conductive pads, each conductive terminal having two resilient arms located at one side of the receiving cavity and having contact portions at their distal ends to be exposed to the receiving cavity and staggered in the front-to-back direction to electrically contact with one single conductive pad.

DETAILED DESCRIPTION OF THE INVENTION

Figure 1:
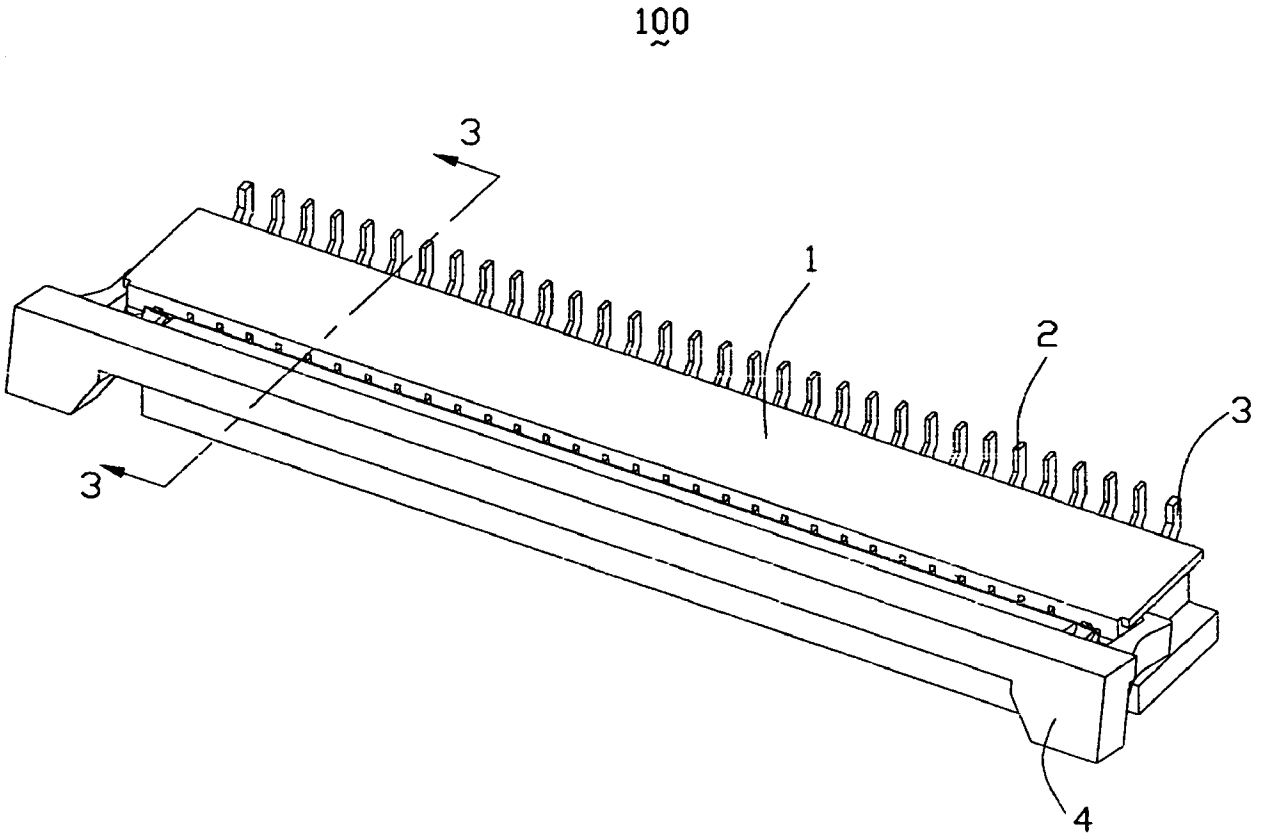
FIG. 1 is an assembled perspective view of an electrical connector in accordance with the present invention.

Reference will now be made to the drawing figures to describe the preferred embodiment of the present invention in detail.

Figure 2:
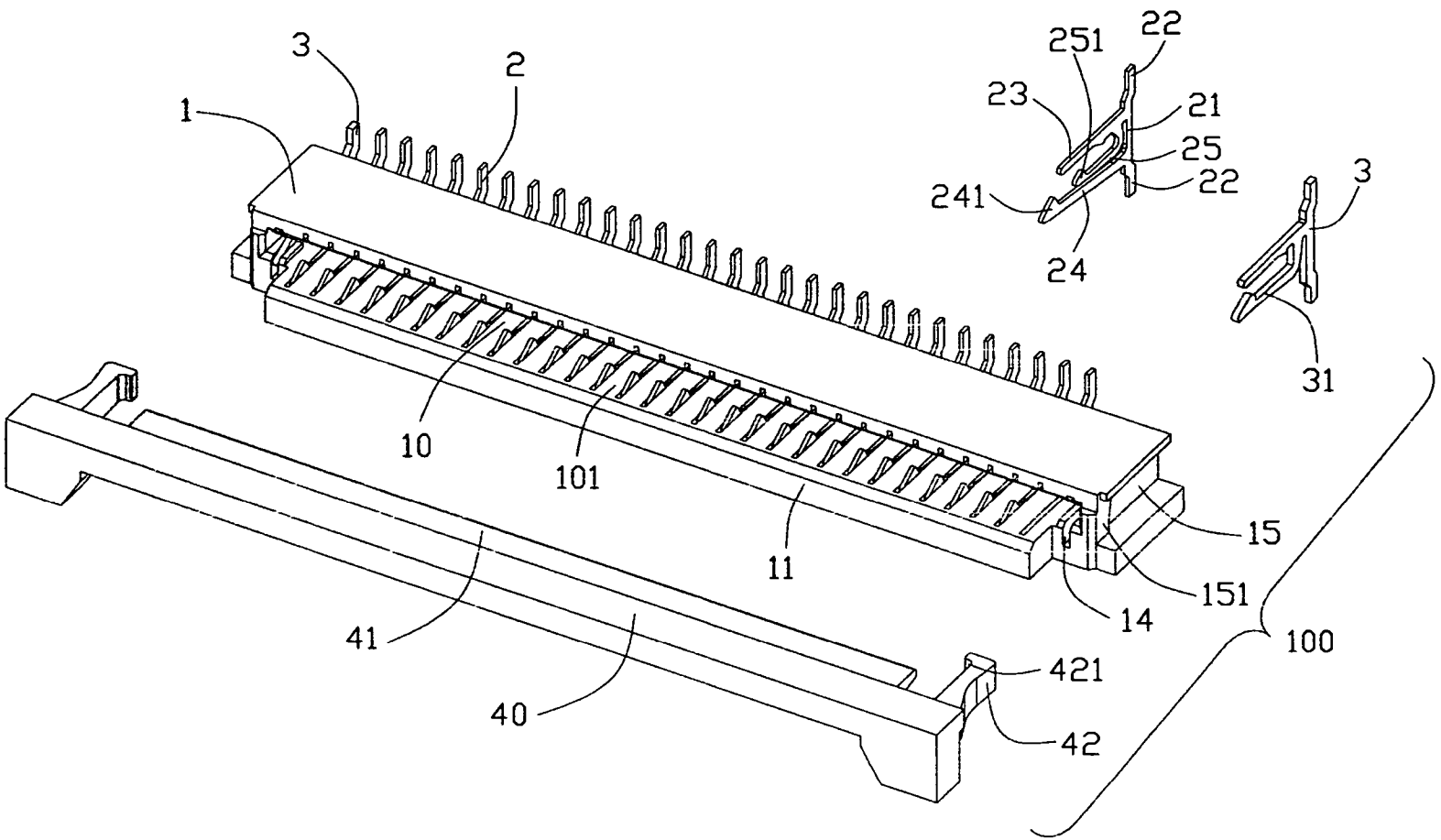
FIG. 2 is an exploded perspective view of the electrical connector shown in FIG. 1.
Figure 4:
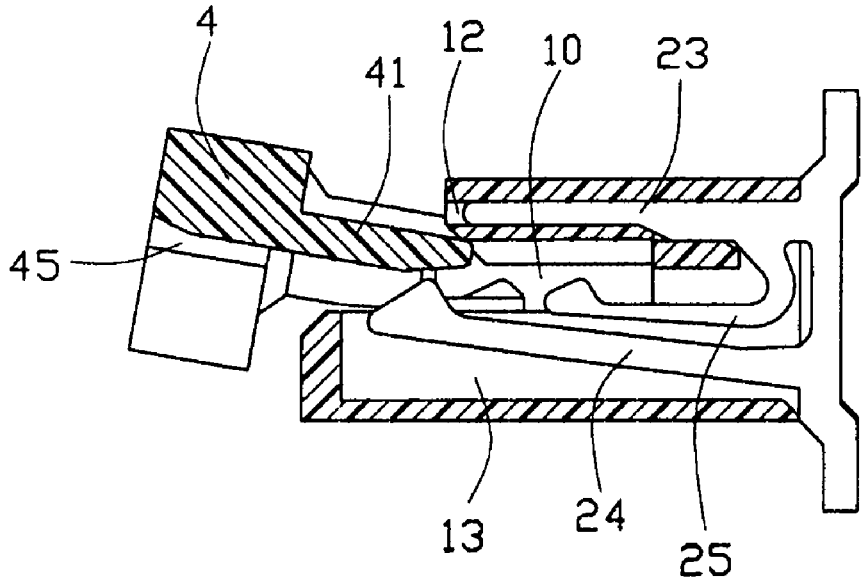
FIG. 4 is a cross-sectional view of the electrical connector shown in FIG. 1 taken along line 3-3, wherein a pressing member is in an opened position.

Referring to FIG. 1 and FIG. 2, an electrical connector 100 in accordance with the present invention is provided. The connector 100 includes a lengthwise insulating housing 1 comprising an upper wall, a lower wall and a receiving cavity 10 between the upper wall and the lower wall. The upper wall and the lower wall respectively define a plurality of terminal grooves 12, 13. A plurality of conductive terminals 2 is retained in the terminal grooves 12, 13. Each terminal 2 comprises a 1 base section 21, a pair of solder portion 22 extending from two ends of the base section 21 to be soldered on the printed circuit broad (PCB), a fixed arm 23 extending forward from the base section 21 to be retained in terminal groove 12 defined by the upper wall, a first resilient arm 24 extending forward substantially parallel to the fixed arm 23, and a second resilient arm 25 branching from a root portion of the fixed arm 23 and extending forward parallel to the first resilient arm 24. The first and second resilient arms 24, 25 of each terminal 2 are jointly received in one terminal groove 13 defined by the lower wall. Each of the resilient arms 24, 25 has a contact portion 241, 251 faced to the fixed arm 23 and exposed to the receiving cavity 10. As shown in FIG. 4, the conductive terminals 2 are inserted into the housing 1 from back along a front-to-back direction. For the first resilient arm 24 extends further than the second resilient arm 25 along the front-to-back direction, the contact portion 241 is in front of the contact portion 251. In order to receive the longer resilient arms 24, the housing 1 further has an extended wall 11 extending forward from the lower wall and beyond the upper wall.

Electrical connector 100 further has a pair of fixed terminals 3. In order to accommodate said fixed terminals 3, the lower wall of the housing 1 defines two channels 14 which are located beside the extended wall 11.

As shown in FIGS. 2 and 4, the housing 1 has a pair of lateral wall for connecting lengthwise ends of the upper and lower walls together. Each lateral wall has a passageway 15 extending along the front-to-back direction through a rear end thereof and a blocking portion 151 at a front end of the passageway 15. For firmly retaining an FPC 5 (shown in FIG. 3) in the housing 1, a pressing member 4 is provided to be movable between an opened position (shown in FIG. 4) and a closed position (shown in FIG. 5). The pressing member 4 has a rectangular base plate 40, a tongue plate 41 extending from the base plate 40 and defining a slanting surface at its distal end for easily inserted in the receiving cavity 10, and a pair of latching beams 42 extending from lengthwise ends of the base plate 40 along a same direction of the tongue plate 41 to slide in the corresponding passageways 15. Each latching beam 42 has a latch 421 at its distal end which is bent toward the tongue plate 41 for being blocked by the blocking portion 151 to prevent the pressing member 4 breaking off the housing 1 when the pressing member is in the opened position.

Figure 3:
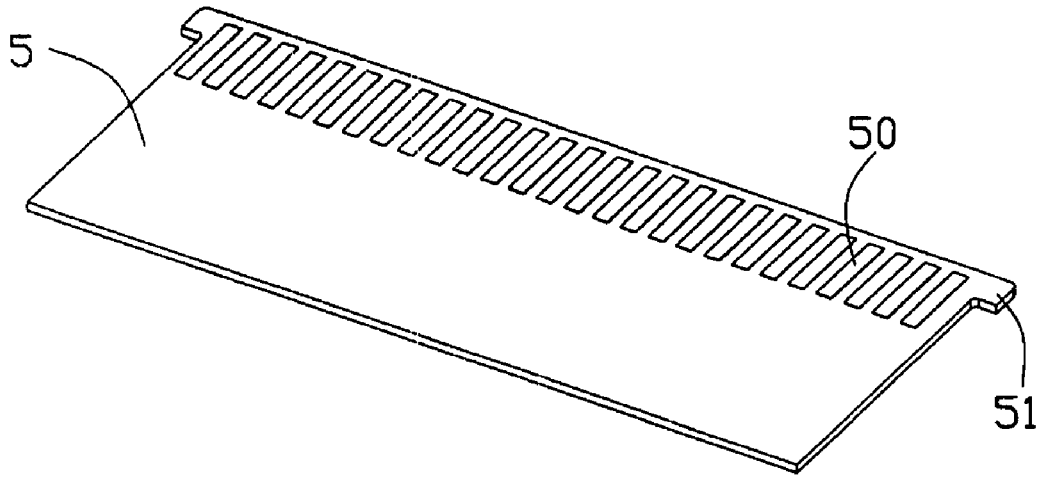
FIG. 3 is an FPC used for being inserted into the electrical connector shown in FIG. 1.

Referring to FIG. 3, the FPC 5 comprises a plurality of conductive pads 50 arranged side by side in a row at its one end for electrically contacting with the contact portions 241, 251 of the terminals 2, and a pair of projections 51 extending outward from lateral sides of the end provided with the conductive pads 50.

Figure 5:
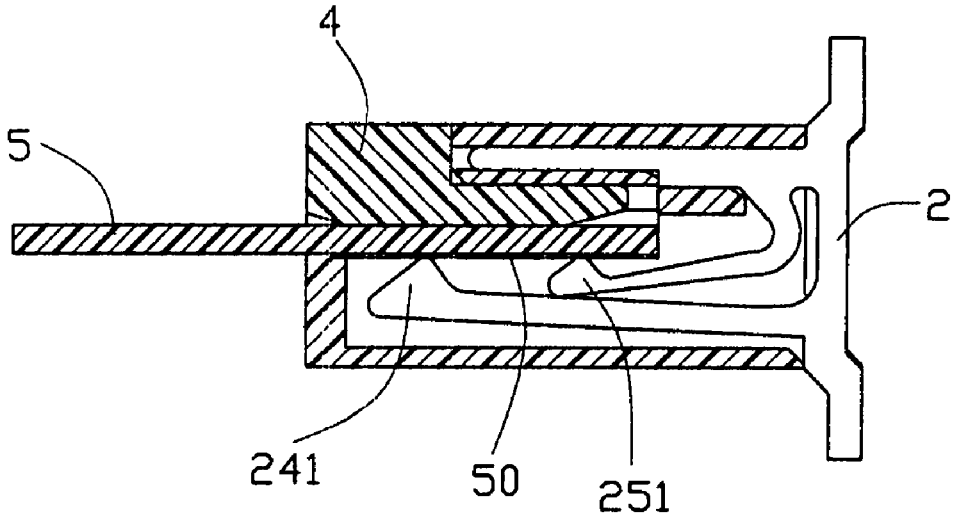
FIG. 5 is a similar view of FIG. 4, wherein the pressing member is in a closed position.

Referring to FIGS. 4 and 5, when assembling FPC 5, the FPC 5 pass through an opening 45 of the base plate 40 of the pressing member 4 to be received in the receiving cavity 10 of the housing 1, and then the pressing member 4 is shifted from the opened position toward the closed position. The tongue plate 41 of the pressing member 4 urges the FPC 5 to move toward the contact portions 241, 251 so that the conductive pads 50 can electrically contact with the corresponding contact portions 241, 251 of the terminals 2. It is noted that the contact portion 241 and the contact portion 251 of one single terminal 2 electrically contact with the identical conductive pad 50 of the FPC. Therefore, even if one of the contact portions 241, 251 cannot fully achieve an electrical connection with the conductive pad 50 by accident, yet the other still can fully achieve an electrical connection. Additionally, if the two contact portions 241, 251 both can fully, electrically contact with the conductive pad 50, a parallel circuit is established thereby resulting the electric resistance is reduced, and the electric performance of the electrical connector is improved accordingly.

Figure 6:
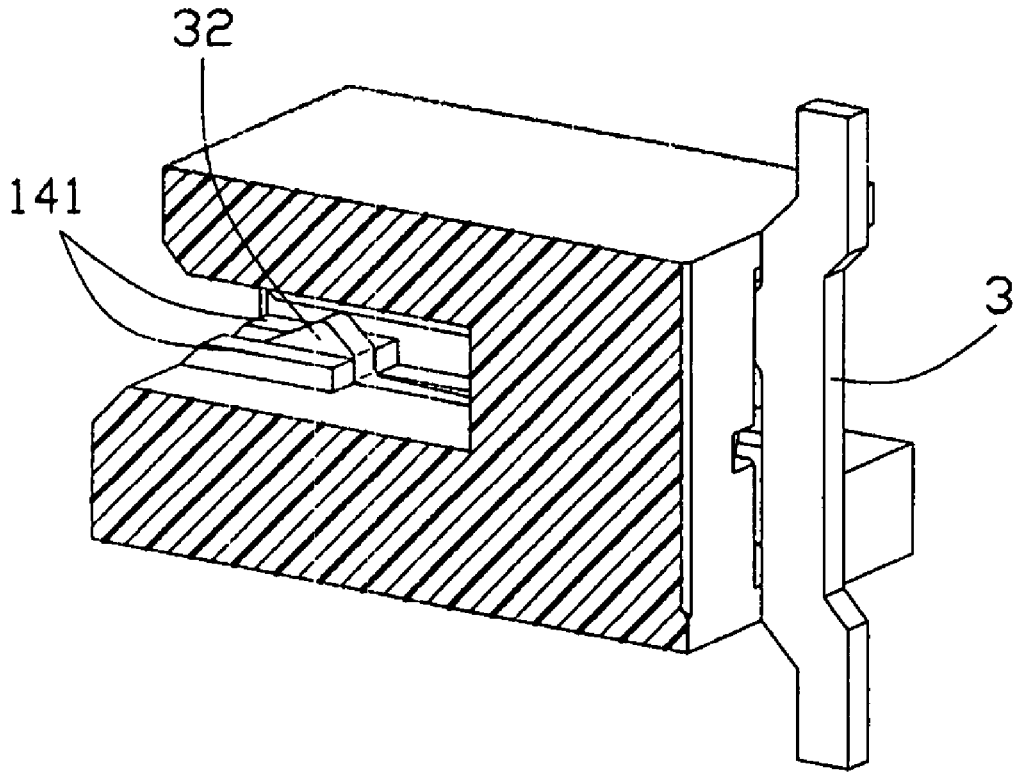
FIG. 6 is a perspective view of a portion of the electrical connector, intending to show the engagement between a fixed terminal and a housing.

Referring to FIG. 6, a plurality of tubers 141 project from the lower wall of the housing 1 to be located beside the channels 14. The tubers 141 cooperate with locking portions 32 provided by resilient arms 31 of the fixed terminals 31 to engage with the projections 51 of the FPC 5 for prevent the FPC 5 being pulled out of the housing 1 without requirement.

The present invention is not limited to the electrical connector 100 mentioned above. This disclosure is illustrative only, change may be made in detail, especially in matter of shapes, size, and arrangement of parts within the principles of the invention. For example, the second resilient arm 25 can be arranged to extend from the base section but not branches from the fixed arm 23.

What is claim is:

1. An electrical connector assembly comprising:

a sheet-like connection member provided with a plurality of conductive pads; and an electrical connector comprising an insulating housing defining a receiving cavity for receiving the sheet-like connection member along a front-to-back direction; and a plurality of conductive terminals retained in the housing to connect the corresponding conductive pads, each conductive terminal having two resilient arms located at one side of the receiving cavity and extending forwardly toward a front opening of the receiving cavity; wherein the two resilient arms have contact portions at their distal ends to be exposed to the receiving cavity and staggered in the front-to-back direction to mechanically and electrically contact with one single conductive pad.

2. The electrical connector assembly as described in claim 1, wherein each conductive terminal is constructed by stamping from one metal plate and said two resilient arms are coplanar.

3. The electrical connector assembly as described in claim 1, wherein the conductive terminal includes a base section, a pair of solder portions extending from two ends of the base section, a fixed arm, and one of said resilient arms extends forward from the base section and the other resilient arm has a different length from said one resilient arm and branches from a root portion of the fixed arm.

4. The electrical connector assembly as described in claim 1, wherein the electrical connector comprises a pressing member including a tongue plate inserted into the receiving cavity to press the sheet-like connection member to electrically connect with the conductive terminals and a pair of latching beams extending along a same direction of the tongue plate to slide at lengthwise ends of the insulating housing.

5. The electrical connector assembly as described in claim 4, wherein the sheet-like connection member has a pair of projections respectively extending outward from lateral sides of the end provided with the said conductive pads, and a pair of fixed terminals are provided by the electrical connector for latching with the projections after the pressing member completely inserted to the receiving cavity.

6. The electrical connector assembly as described in claim 5, wherein the housing has a pair of channels for receiving said fixed terminals and a plurality of tubers beside the channels for cooperating with the fixed terminals to engage with the projections of the sheet-like connection member.

7. An electrical connector comprising:

an insulating housing having a receiving cavity defining an opening at its front end; and a plurality of conductive terminals retained in the housing, each terminal having two resilient arms located at one side of the receiving cavity and each having a contact portion adjacent to said opening and projecting into the receiving cavity;

wherein the contact portion of one resilient arm is located nearer to the opening than that of the other one.

8. The electrical connector as described in claim 7, wherein each terminal comprises a base section, a pair of solder portion extending from two ends of the base section, a fixed arm and said two resilient arms extending forward from and substantially perpendicular to the base section.

9. The electrical connector as described in claim 7, wherein each terminal comprises a base section, a pair of solder portion extending from two ends of the base section, a fixed arm and one of said resilient arms extending forward substantially perpendicular to the base section, and the other of said resilient arms branching from a root portion of the fixed arm.

10. The electrical connector as described in claim 9, wherein the fixed arms of the terminals are located at the other side of the receiving cavity to be opposite to the resilient arms.

11. The electrical connector as described in claim 7, further comprising a pressing member including a tongue plate inserted into the receiving cavity to press the sheet-like connection member to electrically connect with the conductive terminals and a pair of latching beams extending along a same direction of the tongue plate to slide at lengthwise ends of the insulating housing.

12. An electrical connector assembly comprising:

an insulative housing defining a receiving cavity; and a plurality of contacts disposed in the housing, each of said contacts defining a retention arm secured to the housing, and further defining an inner resilient arm and an outer resilient thereof; wherein the inner resilient arm and the outer resilient arm of each of said contacts have separate root sections and are respectively independently deflected when a pressing member and an associated FPC (Flexible Printed Circuit) is inserted into the receiving cavity under a condition that both said inner resilient arm and said outer resilient arm are located on a same side of the inserted pressing member and the associated FPC in the receiving cavity.

13. The electrical connector assembly as described in claim 12, wherein the outer resilient arm defines an outer contacting point and the inner resilient arm defines an inner contacting point.

14. The electrical connector assembly as described in claim 13, wherein the root section of the inner resilient arm is located at a level higher than that of the outer arm.

15. The electrical connector assembly as described in claim 14, wherein the outer resilient arm extends essentially in a straight manner while the inner resilient arm extends downwardly and curvedly.

16. The electrical connector assembly as described in claim 13, wherein the housing defines a recessed structure on an upper front portion thereof, and a front face of said upper front portion is essentially located between the outer contacting point and the inner contacting point in a front-to-rear direction.

17. The electrical connector assembly as described in claim 12, wherein said inner resilient arm is essentially partially embraced by said outer resilient arm.

18. The electrical connector assembly as described in claim 12, wherein the retention arm is located on the other side of the inserted pressing member and the associated FPC in the receiving cavity.

19. The electrical connector assembly as claimed in claim 18, wherein the outer resilient arm defines an outer contacting point and the inner resilient arm defines an inner contacting point.

20. The electrical connector assembly as described in claim 19, wherein the outer resilient arm extends essentially in a straight manner while the inner resilient arm extends downwardly and curvedly.

* * * * *